United States Patent [19]

Tsuyguchi et al.

[11] Patent Number: 5,051,302

[45] Date of Patent: Sep. 24, 1991

[54] MULTI-USABLE HEAT TRANSFER INK RIBBON

[75] Inventors: Hiromi Tsuyguchi, Ibaraki; Masao Saisho, Osaka; Katsuhiro Yoshida, Ibaraki, all of Japan

[73] Assignee: Fuji Kagakushi Kogyo Co., Ltd., Osaka, Japan

[21] Appl. No.: 559,447

[22] Filed: Jul. 26, 1990

Related U.S. Application Data

[63] Continuation of Ser. No. 292,179, Dec. 30, 1988, abandoned.

[30] Foreign Application Priority Data

Aug. 8, 1988 [JP] Japan ..... 63-202421

[51] Int. Cl.[5] ..... B41M 5/62

[52] U.S. Cl. ..... 428/323; 428/195; 428/207; 428/913; 428/914

[58] Field of Search ..... 428/195, 207, 212, 334–336, 428/484, 488.1, 913, 914, 402, 323

[56] References Cited

U.S. PATENT DOCUMENTS 4,681,796 7/1987 Maehashi et al. ..... 428/488.1

FOREIGN PATENT DOCUMENTS 0063000 10/1982 European Pat. Off. .
0163297 12/1985 European Pat. Off. .
56-89984 7/1981 Japan .
57-185191 11/1982 Japan .
61-51386 3/1986 Japan .
61-114891 6/1986 Japan .
61-162395 7/1986 Japan .
61-255894 11/1986 Japan .
61-291185 12/1986 Japan .
62-261481 11/1987 Japan .
62-275778 11/1987 Japan .
62-280077 12/1987 Japan .

*Primary Examiner*—Pamela R. Schwartz
*Attorney, Agent, or Firm*—Armstrong, Nikaido, Marmelstein, Kubovcik & Murray

[57] ABSTRACT

A multi-usable heat transfer ink ribbon comprising a foundation, and a heat transfer ink layer provided on one surface of the foundation, said heat transfer ink layer having a melt index of $4\times10^2$ to $2.5\times10^3$ g/10 min. at 190° C. and containing a vehicle and $3\times10$ to $6\times10\%$ by volume of a nonthermoplastic powder dispersed in a nonagglomerative state, wherein said heat transfer ink layer is capable of being melted or softened to be transferred to a receiving medium in increments relative to the thickness direction of the ink layer upon heating by means of a heating head. The multi-usable heat transfer ink ribbon, though the whole of the ink layer is transferable by incorporating into the ink layer no nontransferable material which hinders the transfer of the ink, can give printed images having the same clearness as that of the printed image obtained by the initial printing even after the ribbon is repeatedly used multiple times for printing.

6 Claims, No Drawings

MULTI-USABLE HEAT TRANSFER INK RIBBON

This application is a continuation of application Ser. No. 292,179 filed Dec. 30, 1988, abandoned.

BACKGROUND OF THE INVENTION

The present invention relates to a multi-usable heat transfer ink ribbon used in a heat transfer type hard copy printer. More particularly, the invention relates to a heat transfer ink ribbon wherein the same portion of the ink layer can be used repeatedly for printing.

Multi-usable heat transfer ink ribbons of this type which have been proposed heretofore include an ink ribbon wherein a nontransferable sponge-like resinous layer is impregnated with a heat transfer ink, an ink ribbon wherein a pigment having strong cohesive force is dispersed in a heat transfer ink to form a barrier like a stone wall against the migration of the ink by agglomeration of the pigment and the ink is flowed out in increments through the barrier, and an ink ribbon wherein porous particles are bonded to each other with a binder to form a porous layer and a heat transfer ink contained in the pores of the porous particles and the voids between the particles is flowed out in increments.

However, all proposals mentioned above have a drawback that since large amounts of the nontransferable materials must be present in the ink layer, the ink layer inevitably becomes thicker as compared with the amount of the transfer ink, which results in formation of unclear printed images. Further, they have another drawback that some portion of the heat transfer ink contained in the ink layer is not flowed out due to capillary action and remains unused in the ink layer.

In other words, the amount of the heat transfer ink which can be effectively used for printing is small as compared to the thickness of the layer containing the heat transfer ink which has a strong dependence with the clearness of printed images, so that clear printed images cannot be obtained at every repeated use. Further, the materials which must not be transferred are transferred by accident, which results in formation of printed images having unevenness in their optical density and formation of incomplete printed images involving defects such as voids and dropout portions at repeated use.

It is an object of the present invention to provide a multi-usable heat transfer ink ribbon which can be used repeatedly many times, though the whole of the ink layer is transferable by incorporating into the ink layer no nontransferable material which hinders the transfer of the ink.

This and other objects of the invention will become apparent from the description hereinafter.

SUMMARY OF THE INVENTION

The present invention provides a multi-usable heat transfer ink ribbon comprising a foundation, and a heat transfer ink layer provided on one surface of the foundation, said heat transfer ink layer having a melt index of $4 \times 10^2$ to $2.5 \times 10^3$ g/10 min. at 190° C. and containing a vehicle and $3 \times 10$ to $6 \times 10$% by volume of a nonthermoplastic powder dispersed in a nonagglomerative state, wherein said heat transfer ink layer is capable of being melted or softened to be transferred to a receiving medium in increments relative to the thickness direction of the ink layer upon heating by means of a heating head.

The melt index is measured according to the provision of ASTM.D1238.

DETAILED DESCRIPTION

According to the multi-usable heat transfer ink ribbon having the above-mentioned construction, the ink layer is transferred in increments relative to the thickness direction thereof, thereby reducing the thickness of the ink layer little by little, at every time when the ink layer is heated by means of a heating head such as thermal head, and finally the whole ink layer of the ribbon is transferred and only the foundation remains in the ribbon.

Consequently, there occur no problems encountered with the prior arts and the number of times of transfer at the same portion of the ink ribbon which is more than that obtained by the ink ribbons of the prior arts is ensured while providing clear printed images.

The mechanism of the transfer of the ink layer is presumed as follows: When the ink layer is heated by means of a heating head, there occur portions at which stress is centered, in the vicinity of the particles constituting the powder dispersed in a nonagglomerative state and, on the other hand, the ink layer is firmly bonded to the foundation due to the presence of the vehicle maintaining a high viscosity in a molten state. As a result, the part of the ink layer which is adjacent to a receiving medium is peeled at an intermediate point of the ink layer thickness and transferred to the receiving medium. However, the reason why the thickness of that part of the ink layer transferred with repeated use remains almost constant has not been determined.

In order to obtain the above effects, it is essential that the melt index of the ink layer is $4 \times 10^2$ to $2.5 \times 10^3$ g/10 min. at 190° C. and the content of the nonthermoplastic powder in the ink layer is $3 \times 10$ to $6 \times 10$% by volume.

When an ink layer having a melt index of about $3 \times 10^3$ g/10 min. at 190° C. is used, almost the whole ink layer present in the portion of the ribbon which is heated is transferred at a time. When an ink layer having a melt index of about $3 \times 10^2$ g/10 min. at 190° C. is used, the optical density of printed images is too low from the initial printing so that clear printed images cannot be obtained. When the content of the powder is about 20% by volume, a large amount of the ink is transferred at a time. Accordingly, the optical density of images obtained by the second and subsequent printing becomes extremely low, which makes impossible the multi-use of the ink ribbon. When the content of the powder is about 70% by volume, the ink layer is almost not transferred.

It is desirable that the melt index of the ink layer is increased, i.e. the ink layer is more softened, with increasing content of the powder.

The present invention will be explained in detail hereinafter.

The vehicle constituting the heat transfer ink layer is preferably composed of a thermoplastic resin as a main component. Thermoplastic resins having a melt index of $4 \times 10^2$ to $2.5 \times 10^3$ g/10 min. at 190° C., particularly $8 \times 10^2$ to $1.5 \times 10^3$ g/10 min. are preferably used singly or as admixtures of two or more kinds thereof. A thermoplastic resin having a melt index outside the above range can be used as far as a mixture prepared by mixing it with another resin has a melt index within the above range.

Examples of the thermoplastic resin are rubber-like resins including copolymers such as ethylene-vinyl acetate copolymer having a vinyl acetate content of 10 to 40% by weight and a melt index of 4 X $10^2$ to 2 X $10^3$ g/10 min at 190° C., ethylene-ethyl acrylate copolymer having an ethyl acrylate content of 10 to 40% by weight having a melt index of 4 X $10^2$ to 2 X $10^3$ g/10 min. at 90° C., styrene-butadiene copolymer and ethylene-acrylic acid copolymer, these copolymers also having such comonomer ratios and polymerization degrees so as to ensure the desirable melt index values, and homopolymers such as polyamides and 1,2-polybutadiene. These resins can be used singly or as admixtures of two or more kinds thereof.

The term "nonthermoplastic powder" used herein means a powder which is not plasticized under the heating conditions for heat transfer. Any nonthermoplastic powder having such a particle size that it is not agglomerated when it is dispersed in the above-mentioned vehicle can be used. A powder having a particle size of not less than 1 X 10 μm, particularly not less than 2 X 10 μm, is preferably used from the point of view of preventing the agglomeration of the powder. A powder having a particle size of not more than 1 X $10^2$ μm is preferably used from the point of view of preventing the printed image from roughening of the surface thereof.

Examples of the nonthermoplastic powder are inorganic pigments having a particle size of 1 X 10 to 1 X $10^2$ μm such as carbon black for use in coloring agent; body pigments such as diatomaceous earth, silica powder and calcium carbonate, and organic pigments.

In the present invention, it is preferable that the nonthermoplastic powder also serves as a coloring agent. However, usual coloring agents such as pigments and dyes may be used together with the nonthermoplastic powder.

In the case of obtaining a black color ink ribbon, it is preferable to use a mixture of two kinds of carbon blacks having particle sizes different from each other within the above particle size range. Such a mixture is advantageous because it provides printed images with a uniform optical density owing to a more homogeneous dispersion of the carbon black powders as a whole.

If necessary, other additives such as dispersing agents, for uniformly dispersing the powder into the ink vehicle, viscosity adjusting agents and surface property modifying agents may be added. Additives used for usual heat melt transfer ink can be used as such additives. Examples of the viscosity adjusting agent are waxes such as paraffin wax, carnauba wax, montan wax, candelilla wax and ester wax. Examples of the surface property modifying agent for reducing the tackiness of the surface of the ink layer are amide waxes such as oleic amide, isostearic amide and N,N'-ethylenebis[oleic amide]. Examples of the dispersing agent are nonionic surface active agents.

The ink layer is formed by solvent-coating the ink composition composed of the above-mentioned components on a foundation, followed by drying. Usually the thickness of the ink layer is 5 to 30 μm.

As the foundation, there can be suitably used plastic films having a thickness of 1 to 20 μm, such as polyester film, polycarbonate film, polysulfone film, fluorine-containing resin film and polyimide film, papers having thickness of 5 to 50 μm, such as condenser paper, india paper and glassine paper, and cellophane having a thickness of 5 to 50 μm.

PREFERRED EMBODIMENTS

The present invention is more specifically described and explained by means of the following Examples. It is to be understood that the present invention is not limited to the Examples, and various change and modifications may be made in the invention without departing from the spirit and scope thereof. In the Examples, M.I. means melt index at 190° C.

EXAMPLE 1

Forty seven parts (parts by volume, hereinafter the same) of ethylene-vinyl acetate copolymer (M.I.: 1,200 g/10 min) as a main component of the vehicle, 14 parts of paraffin wax (mp: 65° C.) as viscosity adjusting agent, 1 part of N,N'-ethylenebis[oleic amide] as a surface modifying agent, and 24 parts of carbon black (average particle size: 18 μm) and 14 parts of carbon black (average particle size: 56 μm) as a nonthermoplastic powder (which served also as a coloring agent) were dissolved or dispersed into, a volatile solvent to give an ink coating liquid. The ink which was obtained by vaporizing the volatile solvent from the ink coating liquid had a M.I. of 1,200 g/10 min and a softening temperature (which means the temperature corresponding to the maximum peak in the differential scanning calorimetry curve) of 65° C.

The ink coating liquid was applied to a polyethylene terephthalate film having a thickness of 4.5 μm so that the thickness of the resulting coating after being dried became 7 μm, and after evaporation of the solvent, cooled to an ordinary temperature to give a multi-usable heat transfer ink ribbon having a heat transfer ink layer.

EXAMPLES 2 AND 3 AND COMPARATIVE EXAMPLES 1 AND 2

The same procedures as in Example 1 except that the main component of the vehicle, the viscosity adjusting agent, the surface property modifier and the nonthermoplastic powder (serving also as a coloring agent) shown in Table 1 were used, were repeated to give heat transfer ink ribbons.

TABLE 1

| | Ink composition*1 | | | | Properties of ink layer | |
|---|---|---|---|---|---|---|
| | Main component of vehicle*2 (%) | Viscosity adjusting agent (%) | Surface property modifying agent*3 (%) | Nonthermoplastic powder*4 (%) | M.I. (g/10 min.) | Softening temperature (°C.) |
| Ex. 1 | EVA.I(47) | Paraffin wax (mp: 65° C.)(14) | Amide wax(1) | Carbon A (24) Carbon B (14) | 1,200 | 65 |
| Ex. 2 | EVA.II(47) | Paraffin wax (mp: 63° C.)(14) | Amide wax(1) | Carbon A (24) Carbon B (14) | 400 | 70 |
| Ex. 3 | EVA.III(47) | Paraffin wax (mp: 68° C.)(14) | Amide wax(1) | Carbon A (24) Carbon B (14) | 2,500 | 60 |

TABLE 1-continued

| | Ink composition*1 | | | | Properties of ink layer | |
|---|---|---|---|---|---|---|
| | Main component of vehicle*2 (%) | Viscosity adjusting agent (%) | Surface property modifying agent*3 (%) | Nonthermoplastic powder*4 (%) | M.I. (g/10 min.) | Softening temperature (°C.) |
| Com. Ex. 1 | EVA.I(14) | Paraffin wax (mp: 65° C.)(47) | Amide wax(1) | Carbon A (38) | *5 | 60.5 |
| Com. Ex. 2 | EVA.I(23) | Paraffin wax (mp: 65° C.)(7) | — | Carbon B (70) | 1,100 | 65 |

*1Each numeral in each parentheses after each component means the proportion of each component to the total ink in terms of percentage by volume which is calculated by the following formula:

$$\frac{(\text{percent by weight of a component}) \times (\text{Specific gravity of the total ink})}{(\text{Specific gravity of said component})}$$

*2EVA.I: Ethylene-vinyl acetate copolymer having a M.I. of 1,200 g/10 min.
EVA.II: Ethylene-vinyl acetate copolymer having a M.I. of 400 g/10 min.
EVA.III: Ethylene-vinyl acetate copolymer having a M.I. of 2,500 g/10 min.
*3Amide wax: N,N'-ethylenebis[oleic amide]
*4Carbon A: Carbon black having an average particle size of 18 μm
Carbon B: Carbon black having an average particle size of 56 μm
*5Unmeasurable due to a low viscosity Employing each of the obtained heat transfer ink ribbons, printing was carried out multiple times at the same portion of the ink ribbon to determine the multi-usability and clearness of printed images.

The results are shown in Table 2. In Table 2, the multi-usability is indicated in terms of "optical density (OD value)" of the printed image. Generally the allowable lower limit of the optical density of the printed image is about 0.5. The clearness of the printed image was evaluated according to the following criterion:

A: A line of 0.2 mm thick was formed without any voids or dropout portions.

B: A line of 0.4 mm thick was formed without any voids or dropout portions.

C: A line of 0.6 mm thick was formed without any voids or dropout portions.

D: A line of 0.8 mm thick was formed without any voids or dropout portions.

E: A line of 1 mm thick was formed without any voids or dropout portions.

TABLE 2

| | Receiving medium* | Printing speed (CPS) | Optical density (OD) of printed image (clearness of printed image in parentheses) 1st printing | 3rd printing | 5th printing | 7th printing | 9th printing | 10th printing |
|---|---|---|---|---|---|---|---|---|
| Ex. 1 | a | 30 | 1.4(A) | 1.0(A) | 0.8(A) | 0.6(A) | ** | *** |
| | a | 50 | 1.2(A) | 0.8(B) | 0.7(B) | 0.5(B) | " | " |
| | b | 30 | 1.0(B) | 0.8(B) | 0.7(B) | 0.5(B) | " | " |
| | b | 50 | 0.8(B) | 0.7(C) | 0.6(C) | 0.4(C) | " | " |
| Ex. 2 | a | 30 | 1.0(A) | 0.9(A) | 0.8(A) | 0.6(A) | " | " |
| | a | 50 | 0.8(A) | 0.7(B) | 0.6(C) | 0.5(C) | " | " |
| | b | 30 | 0.8(B) | 0.6(B) | 0.6(C) | 0.4(C) | " | " |
| | b | 50 | 0.7(B) | 0.6(C) | 0.5(C) | 0.3(C) | " | " |
| Ex. 3 | a | 30 | 1.5(A) | 0.9(A) | 0.7(A) | 0.5(A) | " | " |
| | a | 50 | 0.9(B) | 0.7(B) | 0.6(C) | 0.5(C) | " | " |
| | b | 30 | 1.3(A) | 0.9(A) | 0.7(A) | 0.5(A) | " | " |
| | b | 50 | 0.9(B) | 0.8(B) | 0.7(C) | 0.5(C) | " | " |
| Com. Ex. 1 | a | 30 | 1.7(A) | 0.3(D) | 0.2(E) | — | — | — |
| | a | 50 | 1.5(A) | 0.3(D) | 0.2(E) | — | — | — |
| | b | 30 | 1.5(B) | 0.4(D) | 0.3(E) | — | — | — |
| | b | 50 | 1.3(B) | 0.3(D) | 0.2(E) | — | — | — |
| Com. Ex. 2 | a | 30 | 0.3(E) | 0.3(E) | 0.3(E) | 0.2(E) | — | — |
| | a | 50 | 0.2(E) | 0.2(E) | 0.1(E) | 0.1(E) | — | — |
| | b | 30 | 0.3(E) | 0.2(E) | 0.1(E) | 0.1(E) | — | — |
| | b | 50 | 0.2(E) | 0.2(E) | 0.1(E) | 0.1(E) | — | — |

*a: A plain paper having a Bekk smoothness of 300 seconds
b: A plain paper for electrophotography having a Bekk smoothness of 30 seconds
**The OD value was unmeasurable due to the presence of many voids in the printed image.
***No printed image could be obtained because the ink did not remain in the ribbon.

In addition to the materials and ingredients used in the Examples, other materials and ingredients can be used in the Examples as set forth in the specification to obtain substantially the same results.

The multi-usable heat transfer ink ribbon of the present invention, though the whole of the ink layer is transferable by incorporating into the ink layer no nontransferable material which hinders the transfer of the ink, can give printed images having the same clearness as that of the printed image obtained by the initial printing even after the ribbon is repeatedly used multiple times for printing.

We claim:

1. A multi-usable heat transfer ink ribbon comprising a foundation, and a heat transfer ink layer provided on one surface of the foundation, said heat transfer ink layer having a melt index of 4 X $10^2$ to 2.5 X $10^3$ g/10 min. at 190° C. and containing (a) a vehicle comprising a thermoplastic resin as its major component in an amount effective to produce said melt index, and (b) 3 X 10 to 6 X 10% by volume based on said ink layer of a non-thermoplastic powder dispersed in a nonagglomerative state in said vehicle, wherein said heat transfer ink layer is capable of being melted or softened to be transferred to a receiving medium in increments relative to the thickness direction of the ink layer upon heating by means of a heating head, said non-thermoplastic powder being present in an amount effective to impart acceptable optical density to images transferred to said receiving medium for more than three images from the same portion of said ink ribbon.

2. The ink ribbon of claim 1, wherein said thermoplastic resin has a melt index of $4 \times 10^2$ to $2.5 \times 10^3$ g/10 min. at 190° C. and said powder has a particle size of 10 to 100 μm.

3. The ink ribbon of claim 2, wherein said powder is at least one member selected from the group consisting of inorganic pigments and organic pigments and has a particle size of 20 to 100 μm.

4. The ink ribbon of claim 2, wherein said powder is a mixture of two kinds of carbon blacks different from each other in their average particle size.

5. The ink ribbon of claim 1, wherein said heat transfer ink layer further contains a viscosity adjusting agent and a surface property modifying agent for reducing the tackiness of the surface of the ink layer.

6. The ink ribbon of claim 1, wherein the nonthermoplastic powder serves as a coloring agent.

* * * * *

UNITED STATES PATENT AND TRADEMARK OFFICE

CERTIFICATE OF CORRECTION

PATENT NO. : 5,051,302

DATED : September 24, 1991

INVENTOR(S) : Hiromi TSUYGUCHI et al

It is certified that error appears in the above-identified patent and that said Letters Patent is hereby corrected as shown below:

On the title page, Item [30], "Aug. 8, 1988" should read -- Aug. 12, 1988 --.

Signed and Sealed this

Twenty-fifth Day of February, 1992

*Attest:*

*Attesting Officer*

HARRY F. MANBECK, JR.

*Commissioner of Patents and Trademarks*